US005791014A

United States Patent [19]

Wong

[11] Patent Number: 5,791,014

[45] Date of Patent: Aug. 11, 1998

[54] HANDLE FOR CARRY-ON LUGGAGE

[75] Inventor: Jacob Y. Wong, Goleta, Calif.

[73] Assignee: Jaesent Inc., Goleta, Calif.

[21] Appl. No.: 828,896

[22] Filed: Mar. 29, 1997

[51] Int. Cl.[6] ..... A47B 95/02

[52] U.S. Cl. ..... 16/115; 190/115

[58] Field of Search ..... 16/115; 190/18 A, 190/115, 117; 280/655, 655.1, 47.24, 47.27, 47.28, 47.29, 47.315

*Primary Examiner*—Chuck Mah

*Attorney, Agent, or Firm*—Daniel C. McKown

[57] ABSTRACT

A retractable and extendable handle for a piece of luggage is provided at its distal end portion with a distal jaw, and spaced from that, a proximal jaw. These jaws facilitate loading the luggage into an overhead luggage compartment. The jaws may be integral parts of the handle, or they may be parts of an attachment that is affixed to an existing handle. With the handle fully extended, the distal jaw is brought up and over the lip of the floor of the overhead luggage compartment, and then with the proximal jaw pushing against the underside of the lip, the luggage is lifted to force the handle to retract into the luggage. Next, the luggage is pivoted upward about the tip of the distal jaw so that the proximal jaw clears the lip of the floor of the compartment. Thereafter, the luggage is pushed horizontally into the compartment.

7 Claims, 5 Drawing Sheets

HANDLE FOR CARRY-ON LUGGAGE

BACKGROUND OF THE INVENTION

1. Field of the Invention

The present invention is in the field of luggage and more specifically relates to an improved handle for carry-on luggage that facilitates loading the luggage into an overhead luggage compartment.

2. The Prior Art

More people are flying today than ever before. Because of chronic mis-handling of luggage by the airlines, more passengers are using carry-on luggage, which is luggage that the traveler carries aboard so as to maintain control of it. Some of the luggage carried aboard may be stored under the passenger's seat, but larger pieces of luggage are placed by the passenger into an overhead luggage compartment which typically runs lengthwise of the passenger compartment above the seated passengers.

A recent improvement in carry-on luggage has been the addition of wheels and a handle that can be extended for use in pushing the luggage as it is being moved along on the wheels, and that can be retracted into the luggage when not needed. These improvements have significantly reduced the effort involved in moving luggage along walkways in airports and from airports to parking garages.

Not withstanding this improved ability to move the luggage around on the ground, a conspicuous problem remains for travelers in handling their heavy carry-on luggage once it is inside the aircraft. The problem, experienced almost universally, is the difficulty of lifting luggage pieces that may weigh as much as 30 or 40 pounds from the floor of the aircraft to an overhead storage compartment that is usually located laterally some distance from the aisle.

To accomplish the task requires an intricate maneuver that includes lifting, rotating, and pushing the heavy luggage while supporting it with both hands above the heads of other passengers. Sometimes, owing to the presence of luggage that is already in the compartment, an attempted maneuver will fail or will have to be modified unexpectedly. Because the maneuver involves such movements as lifting while rotating and supporting a substantial weight at arms length overhead, it calls into action muscles that are not prepared for such strenuous action. All sorts of muscle strains may result, and these may not become noticeable immediately.

In addition to the bodily harm that results from trying to convey the luggage from the floor to the overhead luggage rack, one must also consider the humiliation and potential harm to other passengers that can result from a failed maneuver.

The present inventor, who is not athletically inclined, has long suffered from this problem, and has finally invented an improved handle for the luggage that greatly facilitates the task of raising the luggage from the floor of the aircraft and loading it into the overhead luggage compartment.

SUMMARY OF THE INVENTION

It is an object of the present invention to provide a novel handle for carry-on luggage that will facilitate hoisting the luggage into an overhead luggage compartment.

In accordance with the present invention the handle is provided with an appendage that extends in a generally perpendicular direction from an end portion of the handle. In the following description this appendage is referred to as a distal jaw, although it may have a variety of shapes, as will be seen below. Further in accordance with the present invention, the handle is provided with a second appendage that is spaced toward the luggage from the first appendage, and which is referred to as the proximal jaw below. Like the distal jaw, the proximal jaw may have any of several shapes, which will be described below.

In accordance with the present invention, the distal and proximal jaws may be an integral part of the handle, manufactured as part of the handle, or, in other embodiments the distal and proximal jaws may be separate parts that are attached to the handle either when the handle is manufactured or later as a retrofit. In other embodiments, the distal and proximal jaws are unitary parts of a single attachment that may be affixed to the handle when it is manufactured or later, as a retrofit.

A piece of luggage, such as a suitcase, having a handle of the type described herein permits the luggage to be hoisted into the overhead compartment in the following manner. With the handle fully extended, the distal jaw is brought down over the lip of the luggage compartment and engages it from above. This stabilizes the luggage and supports its weight in whole or in part, as the user wishes. Thereafter, the user operates an actuator that enables retraction of the handle, then pushes the proximal jaw upward against the lower side of the lip of the overhead luggage compartment, thereby forcing the handle to retract into the luggage. Next, with the distal jaw still bearing on the upper side of the lip, the user pivots the luggage upward about the tip of the distal jaw. This maneuver raises the proximal jaw high enough to clear the lip, and thereafter the luggage is pushed laterally into the overhead luggage compartment.

The novel features which are believed to be characteristic of the invention, both as to its structure and its method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
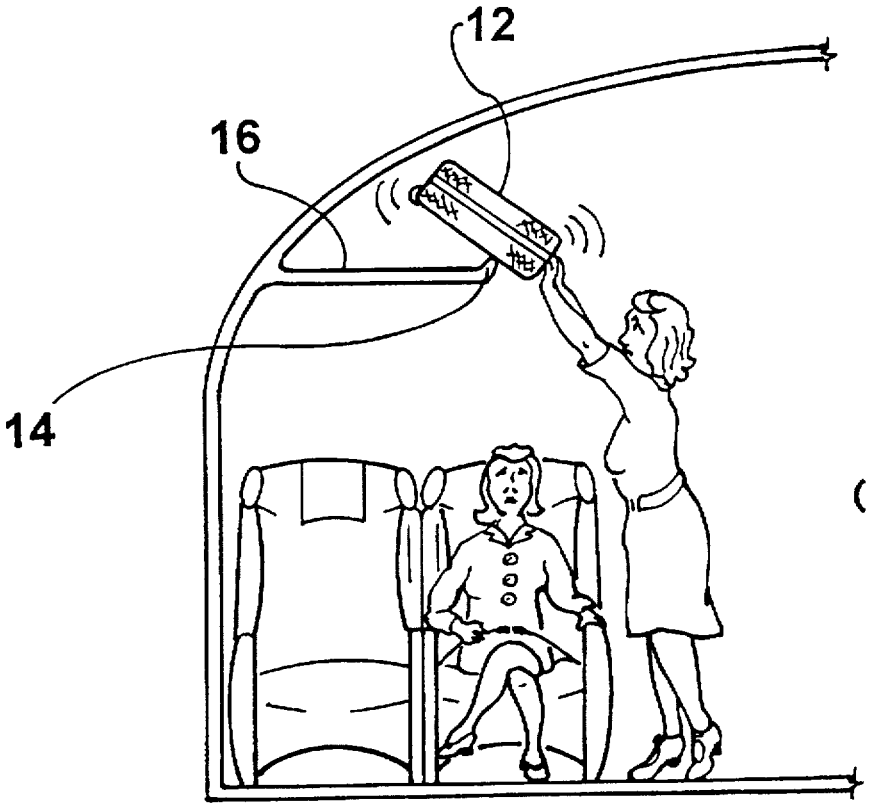
Fig. 1 ( PRIOR ART )
FIG. 1 is a diagram showing the location of an overhead luggage compartment on an airplane and the prior art technique for placing luggage in the compartment.

As suggested in FIG. 1, it is difficult for a person to lift a piece of luggage 12 and to push it over the lip 14 of an overhead luggage compartment to rest on the floor 16 of the overhead luggage compartment. This is particularly true if the person is short of stature or is elderly. It is easy to strain one's back when attempting to manipulate the luggage at arm's length and overhead.

Figure 2:
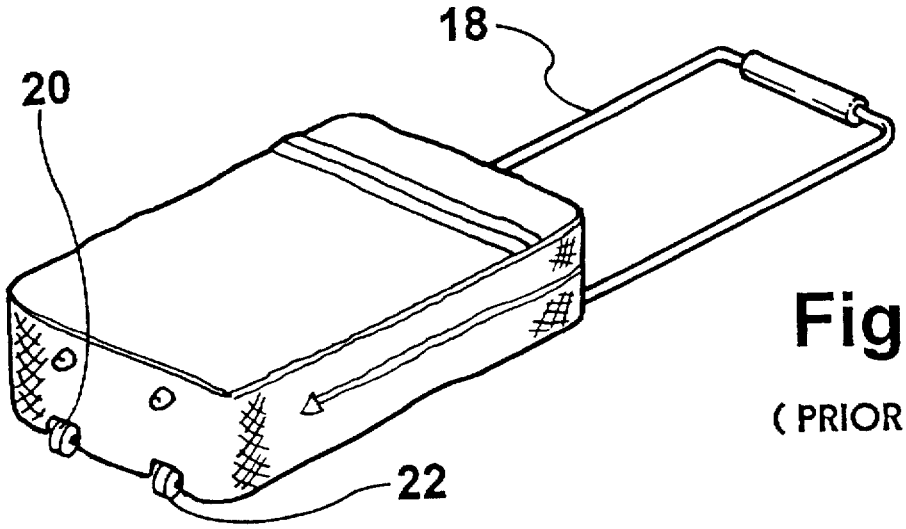
Fig. 2 ( PRIOR ART )
FIG. 2 is a perspective view showing a piece of luggage of a type known in the prior art and with which the present invention is used.

The present invention facilitates the lifting and maneuvering of the luggage, particularly for suitcases of the type shown in FIG. 2, that have a retractable handle 18. Such suitcases are usually equipped with wheels 20 and 22 that permit the suitcase to be handled like a hand-truck.

Figure 3:
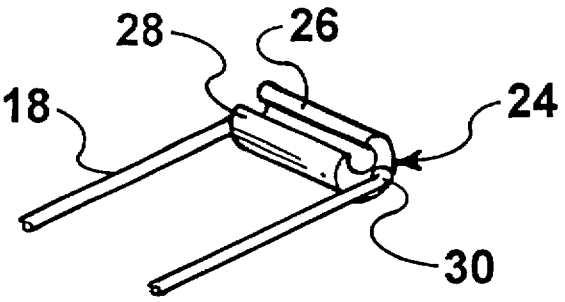
FIG. 3 is a fractional perspective view showing a first preferred embodiment of the present invention.
Figure 4:
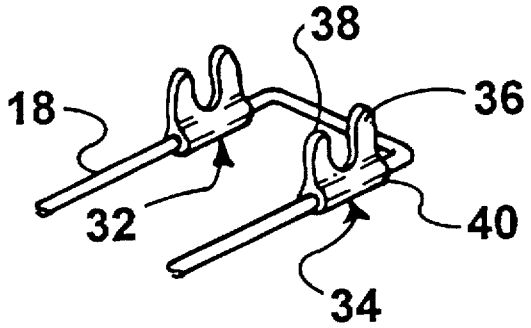
FIG. 4 is a fractional perspective view showing a second preferred embodiment of the present invention.
Figure 5:
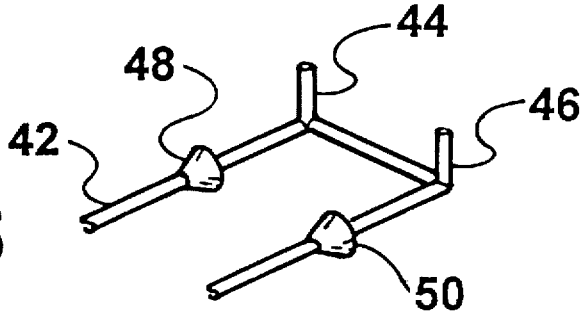
FIG. 5 is a fractional perspective view showing a third preferred embodiment of the present invention.

In accordance with the present invention, the retractable handle 18 is modified by the addition of attachments such as shown in FIGS. 3 and 4 or, in other embodiments, the handle 18 is replaced by the handles shown in FIGS. 5 and 6.

In a first preferred embodiment shown in FIG. 3, the invention is an attachment 24 that has a distal jaw portion 26 and a proximal jaw portion 28. The attachment 24 maybe bonded to an existing handle 18, or maybe fastened to it by one or more set screws. A body portion 30 of the attachment 24 directly contacts the existing handle 18. The attachment 24 of FIG. 3 is an extruded plastic part in the first preferred embodiment.

A second preferred embodiment is shown in FIG. 4, and it consists of two identical attachments 32 and 34. The attachment 34 includes a distal jaw portion 36 and a proximal jaw portion 38. The attachment 34 further includes a body portion 40 that is in direct contact with the handle. In the embodiment of FIG. 4, the attachments 32 and 34 are bonded to the handle, and in variations of this embodiment, the attachments 32 and 34 are clamped onto the handle or are attached to it by fasteners.

FIGS. 3 and 4 show attachments that can be affixed to the handle 18 when it is manufactured, or the attachments may be retrofitted to the handle by a consumer. No attachments are used in the embodiments of FIGS. 5 and 6. In those embodiments, the distal and proximal jaws are an integral part of the handle.

In the third preferred embodiment shown in FIG. 5, the handle 42, which may be composed of a metal or plastic, includes distal jaw portions 44 and 46 that extend from a distal end portion of the handle in a direction that is perpendicular to the direction of retraction and extension of the handle. The handle 42 further includes the proximal jaw portions 48 and 50 that are spaced from the distal jaw portions 44 and 46 respectively.

Figure 6B:
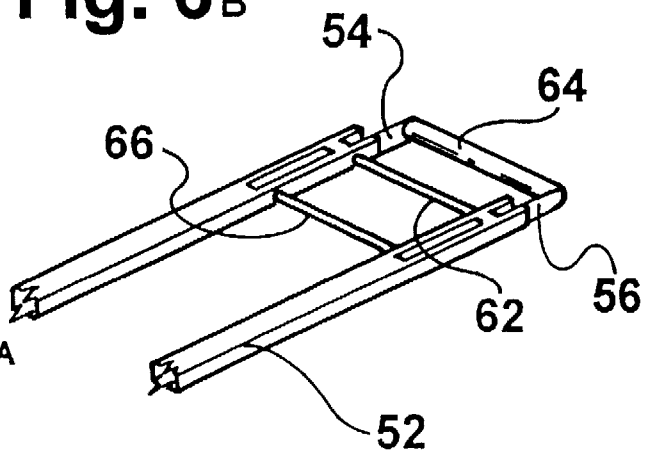
FIG. 6B is a fractional perspective view showing the fourth preferred embodiment of FIG. 6A in a configuration used for pulling the suitcase along a walkway.
Figure 6A:
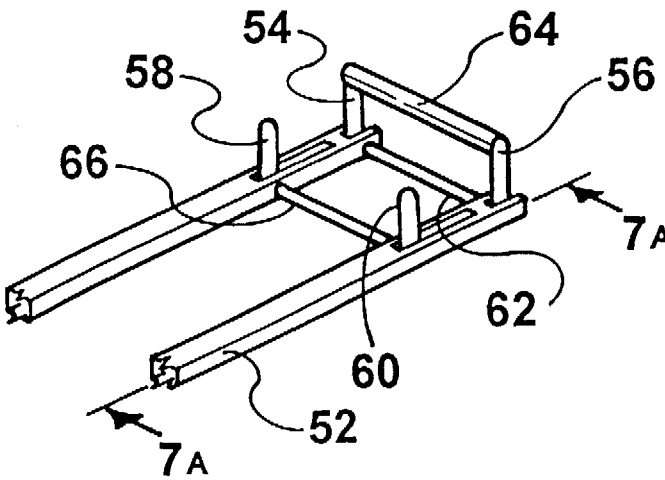
FIG. 6A is a fractional perspective view showing a fourth preferred embodiment of the present invention in a configuration used for loading the suitcase into an overhead luggage compartment.

FIGS. 6A and 6B are fractional perspective views showing a fourth preferred embodiment of the present invention in two configurations. In FIG. 6A, the handle 52 is shown in a configuration used during the process of loading the suitcase into an overhead luggage compartment. FIG. 6B shows a configuration of the handle 52 when the suitcase is being pulled along a walkway or similar surface. In this embodiment, the proximal jaw portions 58 and 60 swing out of the handle 52 as the distal jaw portions are swung from their original position in the plane of the handle, shown in FIG. 6B, to a position perpendicular to the handle, shown in FIG. 6A. The distal jaw portions are connected by a rod 62 as well as by the end piece 64. The proximal jaw portions 58 and 60 are connected by the rod 66 so that they also swing in unison.

Figure 7B:
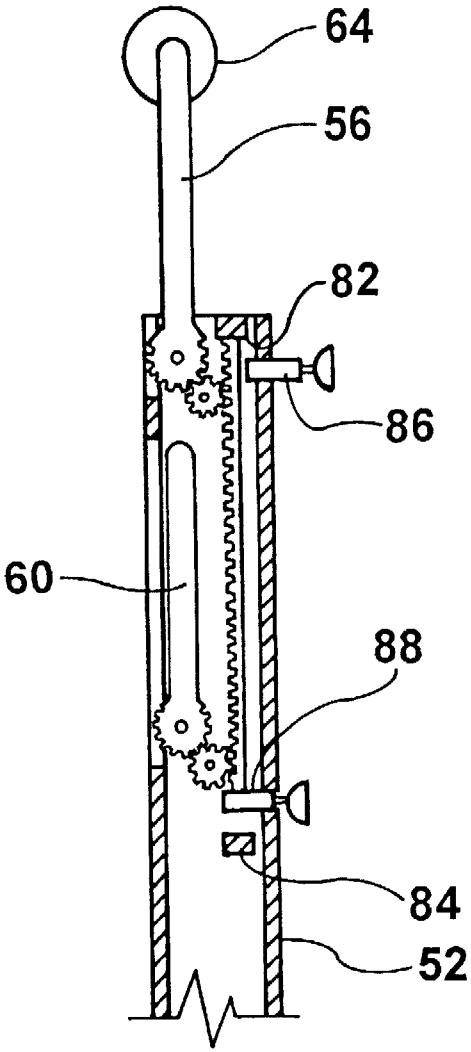
FIG. 7B is a side elevational view partly in cross section showing the mechanism of FIG. 7A when the handle is in the configuration of FIG. 6B.
Figure 7A:
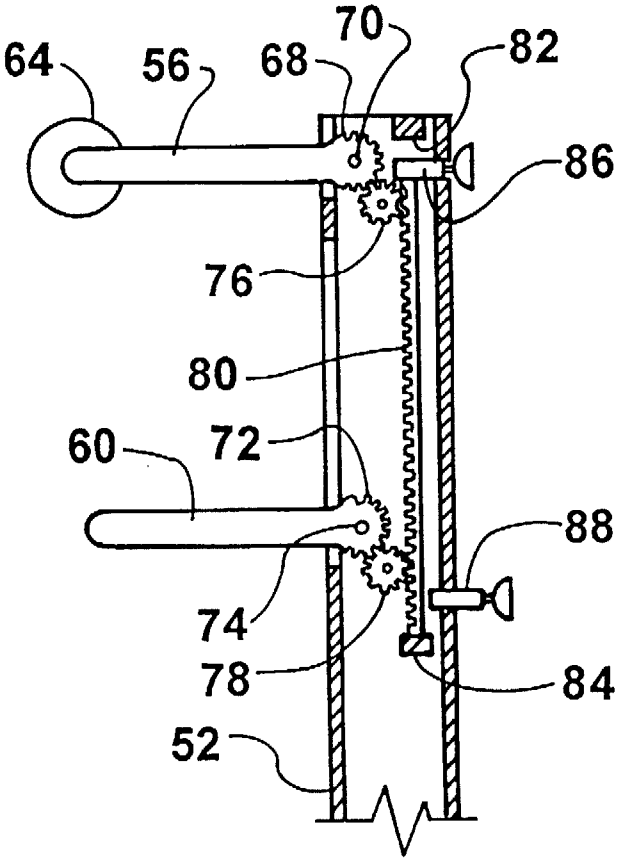
FIG. 7A is a side elevational view partly in cross section in the direction 7A—7A indicated in FIG. 6A showing a mechanism for use in the embodiment of FIGS. 6A and 6B in the configuration shown in FIG. 6A.

Referring now to FIGS. 7A and 7B, the distal jaw portion 56 includes a gear 68 that rotates with the distal jaw portion 56 about the axis 70. Likewise, the proximal jaw portion 60 includes a gear 72 that pivots with it about the axis 74. The gears 68 and 72 intermesh respectively with the gears 76 and 78, and the latter intermesh with the rack 80. Vertical movement of the rack 80 is limited by the fixed stops 82 and 84, as well as by the manually movable stops 86 and 88.

Starting with the mechanism in the configuration of FIG. 7B, the handle may be brought to the configuration of FIG. 7A by the following steps. Note that initially in FIG. 7B, the distal jaw 56 cannot rotate in either direction because of the stops 82 and 88. First, the movable stop 88 is pulled out of position to the position shown in FIG. 7A so as to permit downward motion of the rack 80 which occurs when the distal jaw 56 is rotated counter-clockwise. After the distal jaw has been rotated to the position of FIG. 7A, the movable stop 86 is inserted into the handle to prevent the weight of the suitcase from rotating the distal jaw clockwise. The proximal jaw 60 is pushed against the lip of the luggage compartment to retract the handle, and the pushing force urges the proximal jaw 60 downward as seen in FIG. 7A, but such motion is arrested by the fixed stop 84.

When it is time to return the handle from the configuration of FIG. 7A to the configuration of FIG. 7B, the user must pull out the moveable stop 86, which is preventing clockwise rotation of the distal jaw 56 before rotating the distal jaw 56 clockwise to the original position shown in FIG. 7B. Note that the fixed stop 82 limits clockwise rotation of the distal jaw 56. Next, the user must insert the moveable pin 58, which serves to prevent counter-clockwise rotation of the distal jaw 56 and the proximal jaw 60.

Although FIGS. 7A and 7B show a preferred embodiment of the invention, it is likely that other mechanisms can be devised to produce the same actions.

Figure 9:
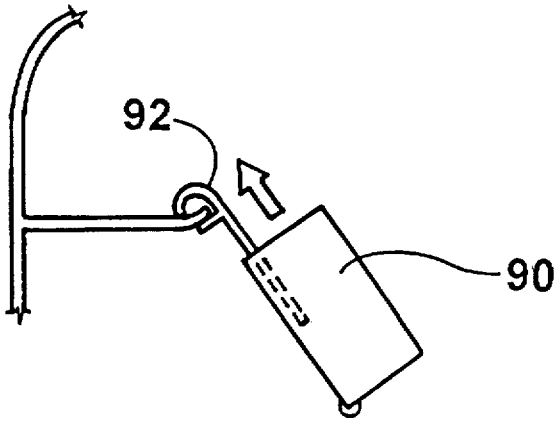
FIG. 9 is a diagram illustrating a second step in the process of loading luggage into an overhead compartment in accordance with the present invention.
Figure 8:
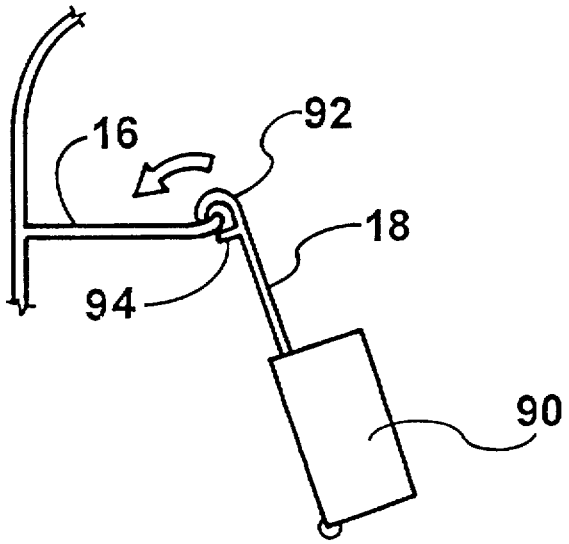
FIG. 8 is a diagram illustrating a first step in the process of loading luggage into an overhead compartment in accordance with the present invention.

FIGS. 8–11 are a series of diagrams that illustrate successive stages in the use of the present invention. With the handle 18 fully extended, the user lifts the suitcase 90 and hooks the distal jaw 92 over the lip 14 of the floor 16 of the luggage compartment. In the preferred embodiment there is a distal jaw on either side of the suitcase, and this greatly stabilizes the handling of the suitcase and also supports the weight of the suitcase until the user is ready to begin the next step, which is shown in FIG. 9. In the next step, of FIG. 9, the user pushes the suitcase 90 upward at an angle while the proximal jaw 94 bears against the lip 14. In this way, the user forces the handle to retract into the suitcase.

Figure 11:
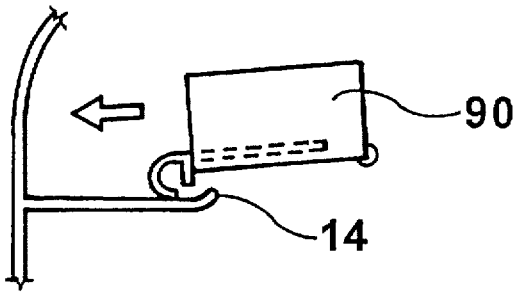
FIG. 11 is a diagram illustrating a fourth step in the process of loading luggage into an overhead compartment in accordance with the present invention.
Figure 10:
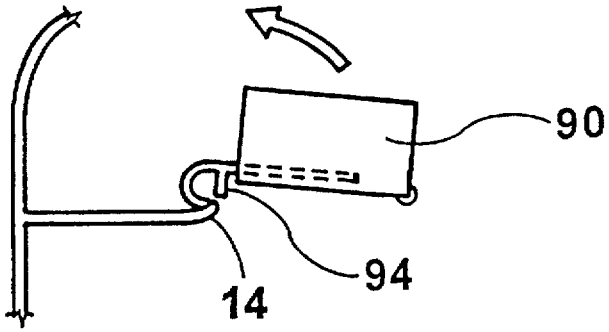
FIG. 10 is a diagram illustrating a third step in the process of loading luggage into an overhead compartment in accordance with the present invention.

As shown in FIG. 10, as the user swings the free end of the suitcase upward, pivoting it about the tip of the distal jaw, the proximal jaw clears the lip. During this phase of the operation, a substantial portion of the weight of the suitcase is borne by the lip. After the proximal jaw has cleared the lip, the suitcase 90 may be pushed into the luggage compartment as indicated in FIG. 11.

Thus, there has been described a novel type of handle for a piece of luggage that facilitates lifting and maneuvering the luggage into an overhead luggage compartment. There has also been described several embodiments of attachments that can be retrofitted to existing luggage handles. Using these handles or attachments of the present invention results in a new and easier method for loading the luggage into an overhead luggage compartment.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. In a retractable handle for a suitcase, or the like, an improvement to facilitate lifting and maneuvering the suitcase up and over the lip of the floor of an overhead luggage compartment and into the compartment, said improvement comprising:

a distal jaw extending from a distal end portion of the handle and being generally perpendicular to the direction of retraction for engaging the lip from above to stabilize and support the suitcase; and, a proximal jaw spaced from said distal jaw and located nearer the suitcase than the distal jaw, extending from the handle and being generally perpendicular to the direction of retraction, for engaging the lip from below to permit a user to retract the handle by lifting the suitcase toward the lip while said proximal jaw bears against the lip.

2. The improvement of claim 1 wherein said distal jaw and said proximal jaw are unitary portions of the handle.

3. The improvement of claim 1 wherein said distal jaw further includes means for affixing said distal jaw to the handle and wherein said proximal jaw further includes means for affixing said proximal jaw to the handle.

4. The improvement of claim 1 further comprising means pivotally connecting said distal jaw to the handle and said proximal jaw to the handle.

5. The improvement of claim 4 further comprising means for selectively locating said distal jaw and said proximal jaw into alternative positions that are generally parallel to and generally perpendicular to the handle.

6. For use with a suitcase, or the like, having an extendable and retractable rigid handle, an article to facilitate lifting and maneuvering the suitcase up and over the lip of the floor of an overhead luggage compartment and into the compartment, said article comprising:

a body portion shaped to receive a distal portion of the handle;

a distal jaw portion extending from said body portion in a direction generally perpendicular to the handle for engaging the lip from above to stabilize and support the suitcase;

a proximal jaw portion spaced from said distal jaw portion and extending from said body portion in substantially the same direction as said distal jaw portion, for engaging the lip from below to permit the user to retract the handle by lifting the suitcase toward the lip while said proximal jaw portion bears against the lip.

7. A method for lifting and maneuvering a suitcase, or the like, up and over the lip of the floor of an overhead luggage compartment and into the compartment said suitcase of a type having an extendable and retractable rigid handle including at its distal end a distal jaw extending generally perpendicular to the handle and a proximal jaw spaced from the distal jaw, said method comprising the steps of:

a) with the handle extended, hooking the distal jaw over the lip to stabilize and support the suitcase;

b) retracting the handle by pushing the suitcase upward toward the lip, with the proximal jaw bearing against the lip;

c) pivoting the suitcase up about the distal jaw, thereby causing the proximal jaw to clear the lip; and, d) pushing the suitcase laterally into the luggage compartment with the weight of the suitcase partly supported on the lip.

* * * * *